United States Patent [19]

Ichihashi

[11] Patent Number: 4,853,139

[45] Date of Patent: Aug. 1, 1989

[54] LUBRICATING OIL COMPOSITION HAVING IMPROVED TEMPERATURE CHARACTERISTICS

[75] Inventor: Toshihiko Ichihashi, Ichihara, Japan

[73] Assignee: Idemitsu Kosan Co., Ltd., Tokyo, Japan

[21] Appl. No.: 183,777

[22] Filed: Apr. 20, 1988

[30] Foreign Application Priority Data

May 14, 1987 [JP] Japan ..... 62-115966

[51] Int. Cl.[4] ..... C10M 145/14; C10M 157/10

[52] U.S. Cl. ..... 252/32.7 E; 252/33.4; 252/52 R; 252/49.6; 252/49.7; 252/51.5 A; 252/50; 252/56 D; 252/56 R

[58] Field of Search ..... 252/56 R, 49.6, 49.7, 252/52 R, 33.4, 51.5 A, 56 D, 32.7 E, 50

[56] References Cited

U.S. PATENT DOCUMENTS

| | | | |
|---|---|---|---|
| 3,175,972 | 3/1965 | Mitacek et al. . | |
| 3,598,738 | 8/1971 | Biswell et al. . | |
| 4,088,589 | 5/1978 | Rossi et al. . | |
| 4,274,973 | 6/1981 | Stanton et al. | 252/56 R |
| 4,611,031 | 9/1986 | Galluccio et al. | 252/56 R |

FOREIGN PATENT DOCUMENTS

| | | |
|---|---|---|
| 208541 | 1/1987 | European Pat. Off. . |
| 3608212 | 9/1987 | Fed. Rep. of Germany . |
| 2212421 | 7/1974 | France . |
| 2229760 | 12/1974 | France . |

*Primary Examiner*—Jacqueline V. Howard

*Attorney, Agent, or Firm*—Frishauf, Holtz, Goodman & Woodward

[57] ABSTRACT

A lubricating oil composition having improved temperature characteristics is disclosed, containing: (A) a base oil having a kinematic viscosity at 100° C. of 1.5 to 50 cSt, a pour point of −25° C. or lower and a viscosity index of at least 60; (B) an ethylene-α-olefin copolymer having a number average molecular weight of 1,000 to 8,000; and (C) at least one additive selected from an extreme pressure agent, an anti-wear agent, an oiliness agent and a detergent dispersant. The present composition has a high viscosity index and exhibits good temperature characteristics, particularly low temperature characteristics, and further is excellent in shear stability, extreme pressure properties, wear resistance, detergency and so on. Thus it is useful as a gear oil for cars or industrial machines, an internal combustion engine oil, an automatic transmission oil and so on.

15 Claims, No Drawings

LUBRICATING OIL COMPOSITION HAVING IMPROVED TEMPERATURE CHARACTERISTICS

BACKGROUND OF THE INVENTION

1. Field of the Invention

The present invention relates to a lubricating oil composition having improved temperature characteristics. More particularly, it is concerned with a lubricating oil composition which can maintain a constant viscosity at high temperatures and even at extremely low temperatures, is low in viscosity and further is excellent in properties such as shear stability, extreme pressure properties, wear resistance, detergency, dispersancy and so on. Therefore, this lubricating oil composition can be used in various applications, for example, as a multi-grade gear oil and a multi-grade engine oil.

2. Description of the Prior Art

Heretofore, in order to improve temperature characteristics of a lubricating oil, a large amount of a polymer compound acting as a viscosity index improver and/or a pour point depressant has been blended thereto.

Lubricating oil compositions thus prepared, however, have disadvantages in that shear stability is poor, viscosity is readily decreased by mechanical shear, and initial lubricating properties are not satisfied, because they contain a large amount of polymer compounds. Not only in this shear stability but also in extreme pressure properties, wear resistance, detergency, dispersancy and so forth, the above lubricating oil compositions are not satisfactory for practical use.

SUMMARY OF THE INVENTION

The present invention is intended to overcome the above problems, and an object of the present invention is to provide a lubricating oil composition which has excellent temperature characteristics over a wide temperature range and is excellent in shear stability and further in extreme pressure properties, wear resistance, detergency, dispersancy and so forth.

It has been found that the object is attained by blending an ethylene-α-olefin copolymer to a specific base oil for lubricating oil which is excellent in low temperature fluidity and further by adding thereto at least one additive selected from an extreme pressure agent, an anti-wear agent, an oiliness agent and a detergent dispersant.

The present invention relates to a lubricating oil composition having improved temperature characteristics, containing:

(A) a base oil having a kinematic viscosity at 100° C. of 1.5 to 50 cSt, a pour point of −25° C. or lower, and a viscosity index of at least 60;

(B) an ethylene-α-olefin copolymer having a number average molecular weight of 1,000 to 8,000; and (C) at least one additive selected from an extreme pressure agent, an anti-wear agent, an oiliness agent and a detergent dispersant.

DESCRIPTION OF PREFERRED EMBODIMENTS

For the base oil to be used as the component (A) of the present composition, the kinematic viscosity at 100° C. is 1.5 to 50 cSt and preferably 2 to 30 cSt, the pour point is −25° C. or lower and preferably −30° C. or lower, and the viscosity index is at least 60 and preferably at least 70.

If the kinematic viscosity at 100° C. is less than 1.5 cSt, evaporation loss is undesirably large. On the other hand, if it is more than 50 cSt, power loss due to viscosity drag is too large. In connection with pour point, if it is more than −25° C., low temperature characteristics are not satisfactory. In connection with viscosity index, if it is less than 60, temperature dependency of viscosity is large and the desired lubricating oil composition having excellent temperature characteristics cannot be obtained.

As the base oil to be used as the component (A) of the present composition, any mineral oils can be used as long as they have the aforementioned properties.

Representative examples of mineral oils which can be used as the base oil include a purified oil which is obtained by purifying a distillate oil by the usual method, said distillate oil having been obtained by atmospheric distillation of a paraffin base crude oil or an intermediate base crude oil, or by vacuum distillation of a residual oil resulting from the atmospheric distillation, and a deep dewaxed oil which is obtained by subjecting the above purified oil to deep dewaxing treatment. In this case, the process for purification of the distillate oil is not critical, and various methods can be employed. Usually, the distillate oil is purified by applying such treatments as (a) hydrogenation, (b) dewaxing (solvent dewaxing or hydrogenation dewaxing), (c) solvent extraction, (d) alkali distillation or sulfuric acid treatment, and (e) clay filtration, alone or in combination with one another. It is also effective to apply the same treatment repeatedly at multi-stages. For example, (1) a method in which the distillate oil is hydrogenated, or after hydrogenation, it is further subjectd to alkali distillation or sulfuric acid treatment, (2) a method in which the distillate oil is hydrogenated and then is subjected to dewaxing treatment, (3) a method in which the distillate oil is subjected to solvent extraction treatment and then to hydrogenation treatment, (4) a method in which the distillate oil is subjected to two or three-stage hydrogenation treatment, or after the two or three-stage hydrogenation treatment, it is further subjected to alkali distillation or sulfuric acid treatment, (5) a method in which after the treatment of the distillate oil by the methods (1) to (4) as described above, it is again subjected to dewaxing treatment to obtain a deep dewaxed oil, and so forth can be employed.

In the practice of the above methods, it suffices that processing conditions be controlled so that the resulting base oil has a viscosity, a pour point and a viscosity index each falling within the above-specified range.

In particular, a mineral oil obtained by deep dewaxing, i.e., deep dewaxed oil is preferred as the base oil to be used as the component (A) of the present composition. This deep dewaxing treatment is carried out, for example, by solvent dewaxing under severe conditions, or by catalytic hydrogenation dewaxing using a Zeolite catalyst.

The ethylene-α-olefin copolymer to be used as the component (B) of the present composition has a number average molecular weight of 1,000 to 8,000, preferably 2,000 to 5,000. If the number average molecular weight is less than 1,000, the viscosity index is improved only insufficiently. On the other hand, if it is more than 8,000, shear stability is undesirably reduced. This ethylene-α-olefin copolymer is a copolymer of ethylene and α-olefin having 3 to 20 carbon atoms, such as propylene, 1-butene, 1-decene and the like, i.e., a hydrocarbon synthetic oil not containing a polar group.

The proportion of the ethylene-α-olefin copolymer as the component (A) in the present composition is not critical and can be determined appropriately depending on the purpose of use of the composition, the type of the base oil as the component (A) of the present composition, and so forth. In general, the amount of the ethylene-α-olefin copolymer to be blended is 0.5 to 20% by weight, preferably 1 to 10% by weight based on the total weight of the resulting composition. If the amount of the ethylene-α-olefin copolymer blended is too small, the viscosity index is improved only insufficiently. On the other hand, if it is too large, viscosity at low temperatures is increased, which is unsuitable for practical use.

In the present composition, as the component (C), at least one additive selected from an extreme pressure agent, an anti-wear agent, an oiliness agent and a detergent dispersant is used. The proportion of the additive(s) in the present composition is not critical and can be determined appropriately depending on the type of the additive and so forth. Usually the amount of the additive(s) to be blended is 0.5 to 30% by weight, preferably 1 to 20% by weight based on the total weight of the resulting composition. If the amount of the additive(s) blended is too small, the desired properties are not improved sufficiently. On the other hand, if it is too large, various problems such as an increase in corrosiveness are liable to arise.

As the extreme pressure agent, various compounds can be used. Specifically, sulfur-based extreme pressure agents such as sulfides, sulfoxides, sulfones, thiophosphinates, thiocarbonates, fats and oils, sulfurized fats and oils, sulfurized olefin and the like; phosphorus-based extreme pressure agents such as phosphoric acid esters, phosphorous acid esters, phosphoric acid ester amine salts, phosphorous acid ester amine salts and the like; halogen-based extreme pressure agents such as chlorinated hydrocarbons; organometallic extreme pressure agents such as thiophosphoric acid salts (e.g., zinc dithiophosphate (ZnDTP)) and thiocarbamic acid salts, and so on can be used.

Anti-wear agents which can be used include organomolybdenum compounds such as MoDTP, MoDTC and the like; organoboric compounds such as alkylmercaptyl borate and the like; solid lubricant-based anti-wear agents such as graphite, molybdenum disulfide, antimony sulfide, boron-containing compounds, polytetrafluoroethylene and the like, and so on.

Oiliness agents (friction modifiers) which can be used include higher fatty acids such as oleic acid, stearic acid and the like; higher alcohols such as oleyl alcohol and the like; amines; esters; sulfurized fats and oils; chlorinated fats and oils; and so on.

Detergent dispersants which can be used include various metal sulfonates such as calcium sulfonate, magnesium sulfonate, barium sulfonate and the like; phenates; salicylates; succinic acid imides; benzylamines; succinic acid esters; and so on.

In the present composition, as the component (C), the aforementioned extreme pressure agent, anti-wear agent, oiliness agent and detergent dispersant are used, alone or as mixtures comprising two or more thereof, depending on the purpose of use of the composition.

The present composition is basically composed of the above components (A), (B) and (C) as major components. In addition, if necessary, other additives can be added to the present composition. For example, it is effective to add a polymer compound such as polymethacrylate having a number average molecular weight of 10,000 to 250,000, preferably 20,000 to 200,000, and an olefin copolymer having a number average molecular weight of at least 10,000 in a predetermined amount, more specifically in an amount of 0.1 to 20% by weight, preferably 0.5 to 15% by weight based on the total weight of the resulting composition.

In addition, additives such as an antioxidant, a rust preventative, a defoaming agent, a corrosion inhibitor, a colorant and the like can be blended to the present composition appropriately.

As the antioxidant, those conventionally widely used can be used. More specifically, phenol-based antioxidants such as 2,6-di-tert-butyl-4-methylphenol; amine-based antioxidants such as dioctyldiphenylamine; sulfur, phosphorus-based antioxidants such as zinc dithiophosphate; and so on can be used.

As the rust inhibitor, various compounds can be used. For example, carboxylic acids, carboxylic acid salts, sulfonic acid salts, esters, alcohols, phosphoric acids, phosphoric acid salts, and the like can be used.

As the defoaming agent, silicone-based defoaming agents such as dimethylsiloxane, silica gel dispersions and the like; alcohol-based defoaming agents; ester-based defoaming agents; and the like can be used.

As the corrosion inhibitor, benzotriazole and its derivatives, thiazole-based compounds and the like can be used.

As described above, the lubricating oil composition of the present invention has a high viscosity index and is low particularly in low temperature viscosity and, therefore, is good in temperature characteristics, particularly low temperature characteristics. Furthermore, the lubricating oil composition of the present invention is excellent in shear stability, extreme pressure properties, wear resistance, detergency and so forth.

Accordingly, the lubricating oil composition of the present invention can be used widely and effectively as a gear oil for cars or industrial machines, an internal combustion engine oil, an automatic transmission oil, a power steering oil, a hydraulic fluid, a shock absorber oil, a tractor oil, a door check oil, and so forth.

The present invention is described in greater detail with reference to the following examples.

EXAMPLES 1 AND 2, AND COMPARATIVE EXAMPLES 1 TO 6

Lubricating oil compositions having the formulations shown in Table 1 were prepared as multi-grade gear oils having a viscosity grade of 75W/80 or 75W/90, or a similar viscosity grade, determined according to SAE J306b.

These compositions were measured for physical properties. The results are shown in Table 1.

TABLE 1

| | Example 1 | Example 2 | Comparative Example 1 | Comparative Example 2 |
|---|---|---|---|---|
| SAE Viscosity number | 75W/80 | 75W/90 | For comparison with 75W/80 | For comparison with 75W/80 |

TABLE 1-continued

| | | | | |
|---|---|---|---|---|
| Composition (wt %) | | | | |
| Component (A) | | | | |
| Base Oil I*1 | 81.9 | 81.4 | 27.4 | — |
| Base Oil II*2 | 10.0 | 3.0 | 68 | — |
| Base Oil III*3 | — | — | — | 90.3 |
| Base Oil IV*4 | — | — | — | — |
| Component (B) | | | | |
| Ethylene-α-olefin Copolymer*5 | 4.0 | 5.0 | — | — |
| Component (C) | | | | |
| Extreme Pressure Agent (ZnDTP) | 3.5 | 3.5 | 3.5 | 3.5 |
| Other Components | | | | |
| Polymethacrylate A*6 | — | 6.0 | — | 4.8 |
| Polymethacrylate B*7 | — | — | — | 0.4 |
| Polybutene (Mn = 2,000 | — | — | — | — |
| Defoaming Agent | 0.001 | 0.001 | 0.001 | 0.001 |
| Antioxidant | 0.5 | 0.5 | 0.5 | 0.5 |
| Rust Inhibitor | 0.1 | 0.1 | 0.1 | 0.1 |

| | Comparative Example 3 | Comparative Example 4 | Comparative Example 5 | Comparative Example 6 |
|---|---|---|---|---|
| SAE Viscosity number | For comparison with 75W/90 | For comparison with 75W/90 | For comparison with 75W/90 | For comparison with 75W/90 |
| Composition (wt %) | | | | |
| Component (A) | | | | |
| Base Oil I*1 | 81.4 | 80.4 | — | — |
| Base Oil II*2 | — | — | — | — |
| Base Oil III*3 | — | — | — | 74.4 |
| Base Oil IV*4 | — | — | 74.4 | 7.5 |
| Component (B) | | | | |
| Ethylene-α-olefin Copolymer*5 | — | — | — | 13.0 |
| Component (C) | | | | |
| Extreme Pressure Agent (ZnDTP) | 3.5 | 3.5 | 3.5 | 3.5 |
| Other Components | | | | |
| Polymethacrylate A*6 | 15.6 | 10.0 | 21.0 | — |
| Polymethacrylate B*7 | — | — | — | 0.5 |
| Polybutene (Mn = 2,000) | — | 6 | — | — |
| Defoaming Agent | 0.001 | 0.001 | 0.001 | 0.001 |
| Antioxidant | 0.5 | 0.5 | 0.5 | 0.5 |
| Rust Inhibitor | 0.1 | 0.1 | 0.1 | 0.1 |

| | Example 1 | Example 2 | Comparative Example 1 | Comparative Example 2 |
|---|---|---|---|---|
| Kinematic Viscosity at 40° C. (cSt) (JIS K 2283) | 67.73 | 98.11 | 75.183 | 71.74 |
| Kinematic Viscosity at 100° C. (cSt) (JIS K 2283) | 9.356 | 14.18 | 9.385 | 9.519 |
| Viscosity Index (JIS K 2283) | 116 | 148 | 98 | 111 |
| Pour Point (JIS K 2269) | −42.5 | −47.5 | −40.0 | −45.0 |
| Low Temperature Viscosity B.F.*8 at −40° C. (cP) (JP15S-26-85) | 127,000 | 132,000 | >200,000 | 128,000 |
| Shell Four Ball Test (ASTM D2783) | | | | |
| LNL (Last Non-Seizure Load) | 100 | 100 | 100 | 100 |
| WL (Welding Load) | 400 | 315 | 400 | 250 |
| LWI (Load Wear Index) | 58.2 | 54.4 | 59.0 | 50.0 |
| Shear Stability*9 (ASTM D2603) | | | | |
| Rate of Reduction in Viscosity at 100° C. (%) | 0.2 | 3.2 | 0.2 | 5.1 |

| | Comparative Example 3 | Comparative Example 4 | Comparative Example 5 | Comparative Example 6 |
|---|---|---|---|---|
| Kinematic Viscosity at 40° C. (cSt) (JIS K 2283) | 83.60 | 70.12 | 67.36 | 98.65 |
| Kinematic Viscosity at 100° C. (cSt) (JIS K 2283) | 14.80 | 14.30 | 14.20 | 14.99 |
| Viscosity Index (JIS K 2283) | 186 | 195 | 221 | 163 |
| Pour Point (JIS K 2269) | −47.5 | −45.0 | −45.0 | −40.0 |
| Low Temperature Viscosity B.F.*8 at −40° C. (cP) (JP15S-26-85) | 130,000 | 172,000 | 41,800 | >200,000 |
| Shell Four Ball Test (ASTM D2783) | | | | |
| LNL (Last Non-Seizure Load) | 80 | 100 | 80 | 100 |
| WL (Welding Load) | 315 | 200 | 250 | 140 |
| LWI (Load Wear Index) | 49.4 | 42.5 | 40.0 | 59.1 |
| Shear Stability*9 (ASTM D2603) | | | | |
| Rate of Reduction in Viscosity at 100° C. | 9.2 | 6.2 | 13 | 2.0 |

TABLE 1-continued (%)

*[1]Base Oil I: Mineral oil having a viscosity of 5.71 cSt (100° C.), a viscosity index of 92 and a pour point of −45° C.
*[2]Base Oil II: Mineral oil having a viscosity of 11.67 cSt (100° C.), a viscosity index of 93 and a pour point of −42.5° C.
*[3]Base Oil III: Mineral oil having a viscosity of 5.30 cST (100° C.), a viscosity index of 104 and a pour point of −17.5° C.
*[4]Base Oil IV: Mineral oil having a viscosity of 2.246 cSt (100° C.), a viscosity index of 85 and a pour point of −10.0° C.
*[5]Hydrocarbon synthetic oil not containing a polar group, which is a copolymer of ethylene and α-olefin (mainly propylene), having a number average molecular weight (Mn) of 3,600 and a viscosity of 2,000 cSt (100° C.).
*[6]Polymethacrylate A: Polymethacrylate having a number average molecular weight (Mn) of 21,000.
*[7]Polymethacrylate B: Polymethacrylate having a number average molecular weight (Mn) of 62,000.
*[8]B.F.: Brookfield viscosity.
*[9]Shear stability: Shear stability test using supersonic waves under conditions of frequency 10 kHz, amplitude 28μ, time 60 min. and oil amount 30 ml.

The following can be seen from the results of Table 1.

The lubricating oil compositions of Examples 1 and 2 each have a viscosity index of at least 110, a pour point of −40° C. or lower, and a Brookfield viscosity at −40° C. of 150,000 cP or less. Thus they satisfy 75W of SAE viscosity number. Moreover, shear stability is 0.2% for the composition of 75W/80 (Example 1) and 3.2% even for the composition of 75W/90 (Example 2). This is high stability that could not be expected from the usual multi-grade oil. Furthermore the shell four ball test shows that there is no serious reduction in extreme pressure properties due to multi-grading; the extreme pressure properties are sufficiently satisfactory.

In Comparative Example 1, a base oil satisfying the requirements for the component (A) of the present composition, that is, a low pour point mineral oil was used, but an ethylene-α-olefin copolymer as the component (B) was not used. In this composition, if the kinematic viscosity at 100° C. was adjusted to about 9.3 cSt, the Brookfield viscosity at −40° C. could not be maintained at 150,000 cP or less.

In Comparative Example 2, a 75W/80 multi-grade gear oil was prepared using the usual paraffin mineral oil by the usual method. In this case, even though polymethacrylate having the lowest molecular weight (21,000) as commonly used (that is, polymethacrylate which is least subject to shear) was used, the resulting composition was subject to shear more than 20 times that of the composition of Example 1. Furthermore the composition was inferior in extreme pressure properties to that of Example 1.

In Comparative Example 3, a SAE viscosity number 75W/90 of lubricating oil composition was prepared using a base oil (low pour point mineral oil) satisfying the requirements for the component (A) and polymethacrylate, but not using an ethylene-α-olefin copolymer as the component (B). This composition was sufficiently satisfactory in respect of low temperature fluidity, but was subject to as high shear as 9.2% even though polymethacrylate having the lowest molecular weight (21,000) as commonly used was used.

In Comparative Example 4, polybutene was used as the component (B) in place of the ethylene-α-olefin copolymer. This composition, however, was not up to 75W/90 unless polymethacrylate having a molecular weight of 21,000 was added in a larger amount than in Example 2, even though the polybutene was added in a larger amount than the ethylene-α-olefin copolymer. For this reason, the composition was subject to shear about two times that of Example 2, and further its Brookfield viscosity at −40° C. could not be maintained at 150,000 cp or less.

In Comparative Example 5, a 75W/90 of lubricating oil composition was prepared using the usual paraffin mineral oil by the usual method. This composition was not satisfactory in any of shear stability and extreme pressure properties.

In Comparative Example 6, the composition was prepared from the usual paraffin mineral oil and an ethylene-α-olefin copolymer as the component (B). In this composition, however, the Brookfield viscosity at −40° C. was more than 200,000 cP, and the composition failed to satisfy the standards SAE viscosity number of 75W/90.

EXAMPLES 3 AND 4, AND COMPARATIVE EXAMPLES 7 TO 12

Lubricating oil compositions having the formulations shown in Table 2 were prepared as multi-grade engine oils of SAE viscosity number 15W/30 or 10W/30, or its similar grade, according to SAE30.

These compositions were measured for physical properties. The results are shown in Table 2.

TABLE 2

| | Example 3 | Example 4 | Comparative Example 7 | Comparative Example 8 |
|---|---|---|---|---|
| SAE Viscosity number | 15W/30 | 10W/30 | For comparison with 15W/30 | For comparison with 15W/30 |
| Composition (wt %) | | | | |
| Component (A) | | | | |
| Base Oil V*[10] | 59.4 | 84.0 | — | 16.0 |
| Base Oil VI*[11] | 27.6 | — | — | 76.0 |
| Base Oil VII*[12] | — | — | 45.3 | — |
| Base Oil VIII*[13] | — | — | 45.7 | — |
| Component (B) | | | | |
| Ethylene-α-olefin Copolymer | 5 | 7 | — | — |
| Component (C) | | | | |
| Detergent Dispersant | 7.4 | 7.4 | 7.4 | 7.4 |
| Other Components | | | | |
| Polymethacrylate A*[6] | — | — | 0.3 | — |
| Olefin Copolymer*[14] | — | — | 0.7 | — |
| Polybutene (Mn = 2,000) | — | — | — | — |
| Defoaming Agent | 0.001 | 0.001 | 0.001 | 0.001 |
| Antioxidant | 0.5 | 0.5 | 0.5 | 0.5 |

TABLE 2-continued

| Rust Preventative | 0.1 | 0.1 | 0.1 | 0.1 |
|---|---|---|---|---|
| | Comparative Example 9 | Comparative Example 10 | Comparative Example 11 | Comparative Example 12 |
| SAE Viscosity number | For comparison with 10W/30 | For comparison with 10W/30 | For comparison with 10W/30 | For comparison with 10W/30 |
| Composition (wt %) | | | | |
| Component (A) | | | | |
| Base Oil V*10 | — | — | — | 75.0 |
| Base Oil VI*11 | — | — | — | 10.0 |
| Base Oil VII*12 | 65.1 | 62.8 | 85.0 | — |
| Base Oil VIII*13 | 24.5 | 25.0 | — | — |
| Component (B) | | | | |
| Ethylene-α-olefin Copolymer | — | — | 7.0 | — |
| Component (C) | | | | |
| Detergent Dispersant | 7.4 | 7.4 | 7.4 | 7.4 |
| Other Components | | | | |
| Polymethacrylate A*6 | 0.8 | 4.2 | — | — |
| Olefin Copolymer*14 | 1.6 | — | — | — |
| Polybutene (Mn = 2,000) | — | — | — | 7.0 |
| Defoaming Agent | 0.001 | 0.001 | 0.001 | 0.001 |
| Antioxidant | 0.5 | 0.5 | 0.5 | 0.5 |
| Rust Preventative | 0.1 | 0.1 | 0.1 | 0.1 |

| | Example 3 | Example 4 | Comparative Example 7 | Comparative Example 8 |
|---|---|---|---|---|
| Kinematic Viscosity at 40° C. (cSt) (JIS K 2283) | 71.63 | 61.21 | 68.12 | 82.14 |
| Kinematic Viscosity at 100° C. (cSt) (JIS K 2283) | 11.00 | 10.2 | 9.760 | 9.652 |
| Viscosity Index (JIS K 2283) | 144 | 154 | 125 | 94 |
| Pour Point (JIS K 2269) | −47.5 | −47.5 | −27.5 | −42.5 |
| CCS Viscosity*15 at −15° C. (cP) (JIS K 2215) | 30.0 | — | 30.0 | 50.0 |
| CCS Viscosity*15 at −20° C. (cP) (JIS K 2215) | — | 31 | — | — |
| Panel Coaking Test*16 300° C. (mg) | 10 | 15 | 20 | 10 |
| Shear Stability*17 (ASTM D 2603) Rate of Reduction in Viscosity at 100° C. (%) | 0.2 | 0.3 | 6.0 | 0.2 |

| | Comparative Example 9 | Comparative Example 10 | Comparative Example 11 | Comparative Example 12 |
|---|---|---|---|---|
| Kinematic Viscosity at 40° C. (cSt) (JIS K 2283) | 64.07 | 60.51 | 65.34 | 67.20 |
| Kinematic Viscosity at 100° C. (cSt) (JIS K 2283) | 10.49 | 10.71 | 10.8 | 9.0 |
| Viscosity Index (JIS K 2283) | 153 | 169 | 156 | 109 |
| Pour Point (JIS K 2269) | −42.5 | −40.0 | −27.5 | −47.5 |
| CCS Viscosity*15 at −15° C. (cP) (JIS K 2215) | — | — | — | — |
| CCS Viscosity*15 at −20° C. (cP) (JIS K 2215) | 30 | 31 | 53 | 68 |
| Panel Coaking Test*16 300° C. (mg) | 40 | 100 | 20 | 30 |
| Shear Stability*17 (ASTM D 2603) Rate of Reduction in Viscosity at 100° C. (%) | 16 | 31 | 0.2 | 0.4 |

*6Polymethacrylate A: Same as in Table 1.
*10Base Oil V: Having a kinematic viscosity at 100° C. of 4.01 cSt, a viscosity index of 92 and a pour point of −45° C.
*11Base Oil VI: Having a kinematic viscosity at 100° C. of 11.67 cSt, a viscosity index of 93 and a pour point of −42.5° C.
*12Base Oil VII: Having a kinematic viscosity at 100° C. of 4.12 cSt, a viscosity index of 100 and a pour point of −17.5° C.
*13Base Oil VIII: Having a kinematic viscosity at 100° C. of 10.79 cSt, a viscosity index of 104 and a pour point of −15° C.
*14Olefin Copolymer: Ethylene-propylene copolymer having a number average molecular weight (Mn) of 32,000.
*15CCS Viscosity: Cold cranking simulator viscosity.
*16Panel Coaking Test: According to Fed. Test Meth. 791-3462.
*17Shear Stability: Shear stability test using supersonic waves under conditions of frequency 10 kHz, amplitude 28μ, time 30 min. and oil amount 30 ml.

The following can be seen from the results of Table 2.

In the lubricating oil compositions of Examples 3 and 4, the viscosity index was at least 140, the pour point was −40° C. or less, and the CCS viscosity was 35 cP or less at both −15° C. and −20° C. Thus they were satisfactory as multi-grade 10W/30 and 15W/30 oils, satisfying the standards for 10W and 15W of SAE J300. In shear stability, they were 0.2% and 0.3%, respectively, and were excellent like a single grade oil. Furthermore, the deposited amounts in the panel coaking test, as a measure of detergency properties, were as small as 10 mg and 15 mg, respectively.

In Comparative Example 7, a 15W/30 of lubricating oil composition was prepared using the usual paraffin mineral oil, polymethacrylate and a high molecular weight olefin copolymer. The viscosity index and pour point of the composition were 125 and −27.5° C., respectively, unsatisfactory for practical use. The composition was subject to as high shear as 6.0%. Furthermore, the deposited amount in the panel coaking test was 20 mg, which was slightly high.

In Comparative Example 8, a 15W/30 oil was attempted to prepare using only a low pour point mineral oil. The resulting composition, however, was high in low temperature viscosity (50 cP at −15° C.) and failed to satisfy the standards for 15W.

In Comparative Examples 9 and 10, 10W/30 of lubricating oil compositions were prepared from the olefin copolymer and polymethacrylate, and polymethacrylate, respectively, by the usual method. Although the compositions satisfied the standards for 10W/30, they were subject to shear of 16% and 31%, respectively, which was very large as compared with Example 4.

In Comparative Example 11, a 10W/30 of lubricating oil composition was attempted to prepare using the usual mineral oil and an ethylene-α-olefin copolymer having a molecular weight of 3,600. The resulting composition, however, failed to satisfy the low temperature viscosity standards of 10W.

In Comparative Example 12, polybutene and a low pour point mineral oil were used. The resulting composition, however, was low in viscosity index although polybutene having the highest molecular weight among the commercially available polybutenes was used, and failed to satisfy the low temperature viscosity standards of 10W.

What is claimed is:

1. A lubricating oil composition having improved temperature characteristics, containing:

(A) a base oil having a kinematic viscosity at 100° C. of 1.5 to 50 cSt, a pour point of −25° C. or lower and a viscosity index of at least 60;

(B) an ethylene-α-olefin copolymer having a number average molecular weight of 1,000 to 8,000; and (C) at least one additive selected from an extreme pressure agent, an anti-wear agent, an oiliness agent and a detergent dispersant.

2. The composition as claimed in claim 1 wherein the amount of the ethylene-α-olefin copolymer blended is 0.5 to 20% by weight based on the total weight of the composition, and the amount of the additive(s) blended is 0.5 to 30% by weight based on the total weight of the composition.

3. The composition as claimed in claim 1 wherein the base oil is a purified oil or a deep dewaxed oil.

4. The composition as claimed in claim 3 wherein the purified oil is obtained by purifying a distillate oil.

5. The composition as claimed in claim 3 wherein the deep dewaxed oil is obtained by subjecting the purified oil to deep dewaxing treatment.

6. The composition as claimed in claim 1 wherein the ethylene-α-olefin copolymer is a copolymer of ethylene and an α-olefin having 3 to 20 carbon atoms.

7. The composition as claimed in claim 6 wherein the α-olefin is propylene, 1-butene or 1-decene.

8. The composition as claimed in claim 1 wherein the extreme pressure agent is at least one agent selected from sulfur-based extreme pressure agents, phosphorus-based extreme pressure agents, halogen-based extreme pressure agents, and organometallic extreme pressure agents.

9. The composition as claimed in claim 1 wherein the anti-wear agent is at least one agent selected from organomolybdenum compounds, organoboron compounds, and solid lubricant-based anti-wear agents.

10. The composition as claimed in claim 1 wherein the oiliness agent is at least one agent selected from higher fatty acids, higher alcohols, amines, esters, sulfurized fats and oils, and chlorinated fats and oils.

11. The composition as claimed in claim 1 wherein the detergent dispersant is at least one compound selected from metal sulfonates, phenates, salicylates, succinic acid amide, benzylamines, and succinic acid esters.

12. The composition as claimed in claim 1, further containing polymethacrylate having a number average molecular weight of 10,000 to 250,000, or an olefin copolymer having a number average molecular weight of at least 10,000.

13. The composition as claimed in claim 12 wherein the amount of the polymethacrylate or olefin copolymer blended is 0.1 to 20% by weight based on the total weight of the composition.

14. A lubricating oil composition having improved temperature characteristics, containing:

(A) deep dewaxed base oil having a kinematic viscosity at 100° C. of 1.5 to 50 cSt, a pour pint of −30° C. or lower and a viscosity index of at least 60;

(B) an ethylene-α-olefin copolymer hav.ing a number average molecular weight of 1,000 to 8,000; and (C) at least one additive selected from an extreme pressure agent, an anti-wear agent, an oiliness agent and a detergent dispersant.

15. The lubricating oil of claim 14 wherein the viscosity index is at least 70.

* * * * *